United States Patent [19]

Werner

[11] 4,357,508

[45] Nov. 2, 1982

[54] HIGH-VOLTAGE CIRCUIT BREAKER

[75] Inventor: Peter Werner, Frankfurt am Main, Fed. Rep. of Germany

[73] Assignee: Siemens Aktiengesellschaft, Munich, Fed. Rep. of Germany

[21] Appl. No.: 164,576

[22] Filed: Jun. 30, 1980

[30] Foreign Application Priority Data

Jul. 30, 1979 [DE] Fed. Rep. of Germany ..... 2930830

[51] Int. Cl.[3] ..... H01H 33/88

[52] U.S. Cl. ..... 200/148 H; 200/150 C; 200/148 A; 200/146 R

[58] Field of Search ..... 200/150 C, 148 H, 150 G, 200/146 R

[56] References Cited

U.S. PATENT DOCUMENTS

| | | | |
|---|---|---|---|
| 891,306 | 6/1908 | Van Valkenburg | 200/150 C |
| 2,100,753 | 11/1937 | Schofield et al. | 200/150 C |
| 3,356,809 | 12/1967 | Colclaser, Jr. et al. | 200/148 H |
| 3,590,190 | 6/1971 | Colclaser, Jr. et al. | 200/148 H |

FOREIGN PATENT DOCUMENTS

| | | | |
|---|---|---|---|
| 677956 | 7/1939 | Fed. Rep. of Germany | 200/148 H |
| 1088583 | 9/1960 | Fed. Rep. of Germany | 200/150 G |
| 2049735 | 4/1972 | Fed. Rep. of Germany . | |

*Primary Examiner*—Robert S. Macon

*Attorney, Agent, or Firm*—Kenyon & Kenyon

[57] ABSTRACT

Disclosed is a multipole high-voltage circuit breaker of the type comprising a housing into which two stationary contacts per pole extend and a rotatable current bridge which connects and disconnects the stationary contacts upon rotation thereof. Both the stationary contacts and the contacts on the movable bridge are provided with preliminary switching points or contacts and main contact points or contacts. The preliminary contact points make contact before the main contact points and break contact after the main contact points. The arrangement permits arcing at the preliminary contact points only and thereby increases the life of the main contact points.

5 Claims, 2 Drawing Figures

HIGH-VOLTAGE CIRCUIT BREAKER

BACKGROUND OF THE INVENTION

The present invention relates to a high-voltage circuit breaker of the type comprising a housing into which two stationary contacts per pole extend, and a movable current bridge which connects and disconnects the two stationary contacts upon movement thereof.

A high-voltage circuit breaker of the aforementioned type having a rotatable bridge is known in the art. The current-carrying bridge is an S-shaped switching blade having bent ends extending in the "on" position through quenching chambers in which plates are disposed which give off a quenching gas under the heat of the arc. See, for example, German Patent No. 2,049,753.

OBJECTS AND SUMMARY OF THE INVENTION

It is an object of the present invention to provide a high-voltage circuit breaker of the aforementioned type which has a longer life.

It is another object of the present invention to provide a high-voltage circuit breaker of the aforementioned type which has a higher switching capacity.

It is still another object of the present invention to reduce the effects of arcing between the switch contacts of a circuit breaker of the aforementioned type.

In accordance with the invention, means are provided to permit arcing at switch points other than at the main contacts of the circuit breaker. In accordance with the invention, a precursor or closing arc and an interrupting or opening arc, which occur respectively upon making and breaking contact, take place at preliminary switching points only, the main switching points being maintained arc-free and correspondingly free of burn-off.

More particularly, a high-voltage circuit breaker of the type which includes a housing into which two fixed contacts per pole extend and movable contacts secured to a bridge for connecting and disconnecting the fixed contacts upon movement of the bridge, typically a rotatable bridge, comprises in accordance with the invention, main contact means associated with the fixed contacts and main contact means associated with the movable contacts for establishing a main contact between the movable and fixed contacts in a preselected position of the movable bridge, and means associated with the fixed contacts and cooperating means associated with the movable contacts for preliminarily making contact between the fixed and movable contacts prior to making the main contact and for breaking contact between the fixed and movable contacts after breaking the main contact.

In the disclosed embodiment, the main contact means associated with the fixed contacts are disposed at the free end of the fixed contacts and the means for preliminarily making and breaking contact are disposed adjacent to said free end, the means for preliminarily making and breaking contact being smaller in thickness than the thickness of the main contact means for preliminarily making and breaking contact associated with the fixed contacts. The movable contacts comprise a pair of opposed flexible members capable of being spread apart, the means for preliminarily making and breaking contact associated with the movable contacts being disposed at the free end of the flexible members, the main contact means associated with the movable contacts being disposed adjacent to said free end. The spaced members are adapted to be flexed and spread by the thicker main contact means of the fixed contact which enters therebetween.

The preliminary contact means of each fixed contact is wider than the main contact means and extends beyond the main contact means in the direction of movement of the bridge for disconnecting the fixed and movable contacts. The free ends of the flexible members of the movable contacts thereby make contact with a respective preliminary contact means before the flexible members are spread by the respective thicker main contact means of the fixed contacts and hence the preliminary contact means make contact before the main contact means when the bridge is moved to connect the fixed and movable contacts. Upon moving the bridge for disconnecting the fixed and movable contacts, the flexible members return to an unspread condition thereby connecting respective preliminary contact means before the fixed and movable contacts break contact.

Preferably, an electronegative gas is provided in the housing; and vanes are connected to a shaft carrying the movable contacts and stationary flow baffles are disposed in the housing adjacent the fixed contacts for urging the gas towards the fixed contacts.

These and other aspects of the present invention will be more apparent from the following description of the preferred embodiment taken in conjunction with the accompanying drawings and appended claims.

BRIEF DESCRIPTION OF THE DRAWINGS

The present invention is illustrated by way of example and not limitation in the figures of the accompanying drawings in which like references indicate similar parts and in which.

DESCRIPTION OF THE PREFERRED EMBODIMENT

Figure 1:
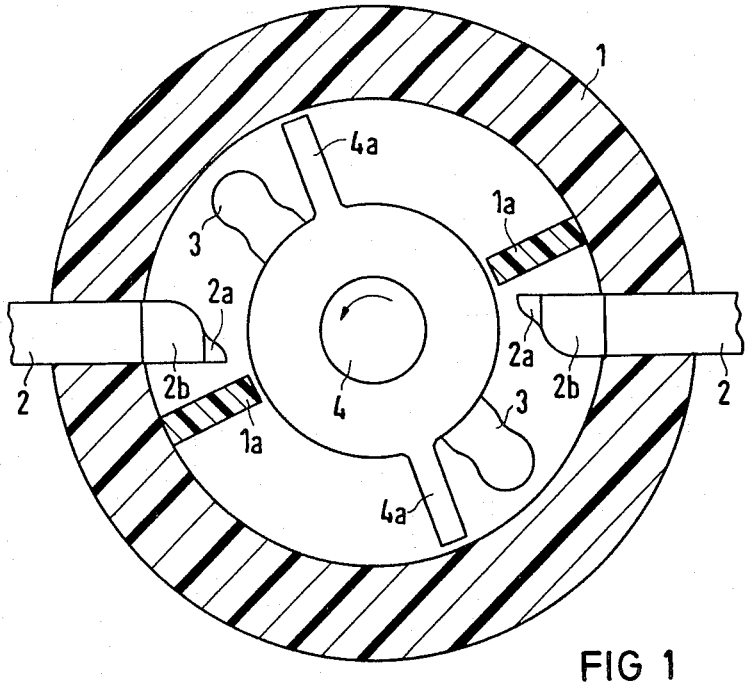
FIG. 1 is a cross-sectional view taken through one pole of a multi-pole high-voltage circuit breaker according to the invention.

Referring to FIG. 1, two oppositely disposed fixed contacts 2 extend into the housing 1 of the multi-pole circuit breaker according to the invention. The contacts 2 can be connected by a rotatable current bridge 3 which is supported by a drive shaft 4 extending through the housing 1. The contacts 2 can be formed as contact blades and have a reinforcement **2*a* at their end protruding into the housing 1**.

The preliminary switching contact **2*b* is disposed adjacent to the main contact 2*a* at a constriction (FIG. 2) adjacent to contact 2*a* and which extends beyond the contact 2*a* in a direction which is opposite to the closing movement of the drive shaft 4** indicated by an arrow.

Figure 2:
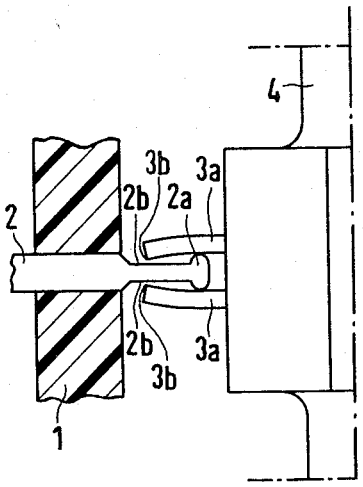
FIG. 2 is a top view in section illustrating the engagement of one of the movable contacts with a stationary contact of the circuit breaker of FIG. 1.

As shown in FIG. 2, the current bridge 3 includes opposed contact jaws or members extending therefrom which can be spread apart by the fixed contact 2. The inner edges of the jaws at the free end thereof are directed inwardly and form preliminary switching points or contacts **3*b* which cooperate with the preliminary switching points or contacts 2*b* of the contacts 2. The main contacts 3*a* of the jaws are located adjacent to the preliminary contacts 3*b***.

In accordance with the invention, the preliminary switching points or contacts 3*b* and 2*b* of the jaws and stationary contacts, respectively, make contact during a closing motion (in the direction of the arrow) of the drive shaft 4 before contact of the main switching points 2*a*, 3*a* takes place.

Conversely, when the drive shaft 4 is rotated to break contact (in the direction opposite to that of the arrow), the main switching points or contacts 3*a*, 2*a* of the current bridge 3 and the fixed contacts 2, respectively, are first separated without an arc before the preliminary switching points or contacts 3*b*, 2*b* of the bridge and fixed contacts, respectively, are separated which forms an arc.

To increase switching capacity, the housing 1 may be filled with an electronegative gas, for example, $SF_6$. Vanes 4*a* can be disposed on shaft 4 and flow baffles 1*a* can be disposed in housing 1. The vanes 4*a* and the baffles 1*a* are formed and arranged so that a flow of the electronegative gas occurs which aids quenching of an arc obtained particularly during the opening motion of the drive shaft 4.

The advantages of the present invention, as well as certain changes and modifications of the disclosed embodiment thereof, will be readily apparent to those skilled in the art. It is the applicant's intention to cover by his claims all those changes and modifications which could be made to the embodiment of the invention herein chosen for the purpose of the disclosure without departing from the spirit and scope of the invention.

What is claimed is:

1. In a high-voltage circuit breaker including a housing into which two fixed contacts per pole extend and movable contacts secured to a bridge for connecting and disconnecting the fixed contacts and the movable contacts upon movement of the bridge, the improvement comprising the fixed contacts each comprising a main contact at an end thereof and a preliminary contact disposed adjacent to said end, each preliminary contact being smaller in thickness than the thickness of the main contact, the movable contacts each comprising a pair of opposed flexible members capable of being spread apart by a respective thicker main contact of the fixed contacts, a preliminary contact being disposed at the free end of the flexible members and a main contact being disposed adjacent to said free end, a respective main contact of the movable contacts adapted to be contacted by a respective thicker main contact of the fixed contacts such that the flexible members are flexed and spread when the main contact of a respective fixed contact enters therebetween, the preliminary contacts and the main contacts of the fixed and movable contacts being adapted to make respective electrical contact, the preliminary contacts of respective fixed contacts and of respective movable contacts cooperating to make electrical contact between the fixed and the movable contacts prior to the main contacts of the fixed and movable contacts making electrical contact, and further cooperating to break electrical contact between the fixed and the movable contacts after the main contacts of the fixed and the movable contacts break electrical contact.

2. The improvement according to claim 1, wherein the fixed contacts of each pole are oppositely disposed and the movable bridge is rotatably mounted in the housing.

3. The improvement according to claim 1 and comprising an electronegative gas in the housing.

4. The improvement according to claim 3 and comprising vanes connected to a shaft carrying the movable contacts and stationary flow baffles disposed in the housing adjacent the fixed contacts for urging gas towards the fixed contacts.

5. The improvement according to claim 1 wherein the preliminary contact of each fixed contact has a greater width than the width of the main contact, the wider preliminary contact extending beyond the main contact in the direction of motion of the bridge which disconnects the fixed and movable contacts such that a respective preliminary contact of the fixed contacts makes contact with respective preliminary contacts of the movable contact before the flexible members are spread by the respective thicker main contact of the fixed contacts and before the main contacts of the fixed and movable contacts make contact when the bridge is moved to connect the fixed and movable contacts, and the flexible members returning to an unspread condition thereby connecting respective preliminary contacts of the fixed and movable contacts before the fixed and movable contacts break contact when the bridge is moved to disconnect the fixed and movable contacts.

* * * * *